US006259195B1

(12) United States Patent
Montie et al.

(10) Patent No.: US 6,259,195 B1
(45) Date of Patent: Jul. 10, 2001

(54) CATHODE RAY TUBE PROVIDED WITH AN ELECTRON GUN, AND ELECTROSTATIC LENS SYSTEM

(75) Inventors: Edwin A. Montie; Jeroen Van Engelshoven; Ronald van der Wilk, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 753 days.

(21) Appl. No.: 08/518,062

(22) Filed: Aug. 22, 1995

(30) Foreign Application Priority Data

Aug. 25, 1994 (EP) ..... 94202432

(51) Int. Cl.[7] ..... H01J 29/51
(52) U.S. Cl. ..... 313/414; 313/456
(58) Field of Search ..... 315/15, 16; 313/414, 313/432, 449, 452, 454, 456

(56) References Cited

U.S. PATENT DOCUMENTS

| | | | | |
|---|---|---|---|---|
| 2,907,916 | | 10/1959 | Beam et al. | 315/16 |
| 2,935,636 | | 5/1960 | Knechtli | 313/82 |
| 2,975,315 | | 3/1961 | Szegho | 313/82 |
| 3,772,554 | * | 11/1973 | Hughes | 313/414 |
| 4,168,452 | | 9/1979 | Christensen et al. | 315/16 |
| 4,731,563 | * | 3/1988 | Bloom et al. | 313/414 |
| 5,300,855 | * | 4/1994 | Kweon | 313/414 |

OTHER PUBLICATIONS

Solid Insulators in Vacuum: A Review by R. Hawley Vacuum, vol. 18 No. 7 Pergamon Press 1968, pp. 383–390 (no month).*

* cited by examiner

*Primary Examiner*—Michael H. Day

(57) ABSTRACT

A cathode ray tube includes an electron gun having a beam-shaping portion (20) for generating electron beams (7–9), a prefocusing system (30) of electrodes (31, 32) across which a prefocusing voltage is supplied during operation so as to form an electron-optical prefocusing lens, and a main lens system (40) of electrodes (32, 41) across which a main lens voltage is applied during operation so as to form an electron-optical main lens. The electrodes (31, 32, 41) are provided with securing means (48) for connection to an insulating supporting body (47) and with apertures (16) for passing the electron beams (7–9). Electrode (32) protrudes toward electrode (31) in such a way that the mutual distance ($l_2$) between the two electrodes at the location of the apertures (16) therein is smaller than their mutual distance ($l_1$) at the location of their respective securing means (48). The two electrodes (31, 32) are spaced apart at the location of the apertures (16) substantially at a distance limited by electrostatic breakdown.

4 Claims, 2 Drawing Sheets

CATHODE RAY TUBE PROVIDED WITH AN ELECTRON GUN, AND ELECTROSTATIC LENS SYSTEM

BACKGROUND OF THE INVENTION

The invention relates to a cathode ray tube comprising an electron gun having a beam-shaping portion having at least one electron source for generating an electron beam, a prefocusing system of electrodes across which a prefocusing voltage is supplied during operation so as to form an electron-optical prefocusing lens, the electron gun further comprising a main lens system of electrodes whose outer electrodes are provided with means for supplying, at least during operation, a main focusing voltage between said electrodes so as to form an electron-optical main focusing lens, said electrodes being provided with at least one aperture for passing the electron beam and with securing means with which the electrodes are secured to an insulating supporting body.

The invention also relates to an electrostatic lens system comprising a prefocusing system of electrodes across which a prefocusing voltage is supplied during operation so as to form an electron optical prefocusing lens, a main lens system of electrodes whose outer electrodes are provided with means for supplying, at least during operation, a main focusing lens, said electrodes being provided with at least one aperture for passing an electron beam and with securing means with which the electrodes are secured to an insulating supporting body.

A device of this type is known from U.S. Pat. No. 4,168,452. The electron gun used in this device is of the tripotential type, in which the outer electrodes of the main lens system are provided with means in the form of electric connections for supplying therebetween, at least during operation, a comparatively large main focusing voltage of the order of 15–20 kV. As in other types of guns, in which a comparatively large main focusing voltage is supplied between the outer electrodes of the main lens system, as in, for example most conventional bipotential guns, this generally has the consequence that during operation only a moderate potential is present on the first electrode of the main lens system, in contrast to unipotential guns in which the outer electrodes of the main lens system both convey the same high potential. Since the first electrode of the main lens system generally also constitutes the last electrode of the prefocusing system, this leads to a moderate prefocusing action of the gun and hence to a poor. beam definition in a device of the type described in the opening paragraph.

To avoid the latter phenomenon, an additional electrode is used in the prefocusing system in the electron gun of the known device, which electrode conveys a higher potential during operation than the first electrode of the main lens system. Thus, a higher field strength in the prefocusing system is realised so that a better prefocusing is obtained, which leads to a sharper electron beam.

A drawback of the known device is, however, that an extra electrode is required for the realised improvement of the beam definition, which does not only have a cost-increasing effect but also requires more space and, under circumstances, an extra electrical connection in the gun.

SUMMARY OF THE INVENTION

It is, inter alia an object of the invention to provide a device of the type described in the opening paragraph in which the prefocusing is improved without the addition of an extra electrode.

According to the invention, a device of the type described in the opening paragraph is therefore characterized in that the prefocusing system of electrodes comprises a pair of adjacent electrodes, at least one of which protrudes towards the other in such a way that the distance between the two electrodes at the location of the apertures therein is smaller than at the location of the respective securing means thereof, and in that the electrodes at the location of the apertures provided therein are spaced apart substantially at a distance which is limited by electrostatic breakdown. Within the scope of the invention, a distance which is still just justified with a view to electrostatic breakdown and within the prevailing positioning and other process tolerances is maintained between the two electrodes at the location of the apertures.

The invention is based on the recognition that the minimum mutual distance between adjacent electrodes is mainly determined by the mutual distance between the securing means in the insulating supporting body. Generally, the electrostatic breakdown voltage along the insulating material of the supporting body is considerably lower than the breakdown voltage in the prevailing vacuum. For securing means which are in alignment with the electrodes, the maximum field strength between the electrodes is therefore limited to said breakdown voltage along the insulating support. By placing the securing means of the relevant pair further apart in accordance with the invention, rather than in alignment with the electrodes, it is achieved that both electrodes can be placed closer together and that their minimum mutual distance at the location of the apertures therein is only limited by the electrostatic breakdown voltage in the prevailing vacuum. In practice this means that the distance between the two electrodes at the location of the aperture therein approaches the theoretical minimum value of the quotient of the prefocusing voltage and the maximum electric field strength in the vacuum prevailing in the envelope, while allowing for inevitable positioning tolerances of the electrodes and ambient fluctuations in the device. The field strength to which an electron beam between the two electrodes is subject and hence the prefocusing may consequently be increased without an extra electrode having an extra (high) voltage being required for this purpose. Thus, in practice a considerable improvement of the beam homogeneity and hence the spot quality can thus be achieved.

In most conventional cases, the maximum electric field strength along the supporting body is approximately a factor of three lower than that in the prevailing vacuum. A particular embodiment of the device according to the invention is therefore characterized in that the distance between the two electrodes at the location of the apertures therein is approximately a factor of the smaller than at the location of the respective securing means thereof.

Generally, such a vacuum prevails in the evacuated envelope of a device of the type described in the opening paragraph that a maximum field strength of between 7 and 12 kV/mm can be achieved, while the maximum field strength along the insulating supporting body is generally limited to approximately 3 kV/mm. A further embodiment of the device according to the invention is therefore characteried in that the distance between the two electrodes is between one-seventh and one-twelfth of the prefocusing voltage, while the distance between the securing means is larger than one-third of the prefocusing voltage, with said distances being expressed in millimeters and said prefocusing voltage being expressed in kilovolts. In that case the electron gun can be used without any problems, in substantially any conventional device of the type described in the opening paragraph.

These and other aspects of the invention will be apparent from and elucidated with reference to the embodiments described hereinafter.

BRIEF DESCRIPTION OF THE DRAWING

In the drawing.

The drawing figures are purely diagrammatic and not to scale. For the sake of clarity, some dimensions are exaggerated. Corresponding components in the figures have been given the same reference numerals as much as possible.

DESCRIPTION OF THE PREFERRED EMBODIMENTS

Figure 1:
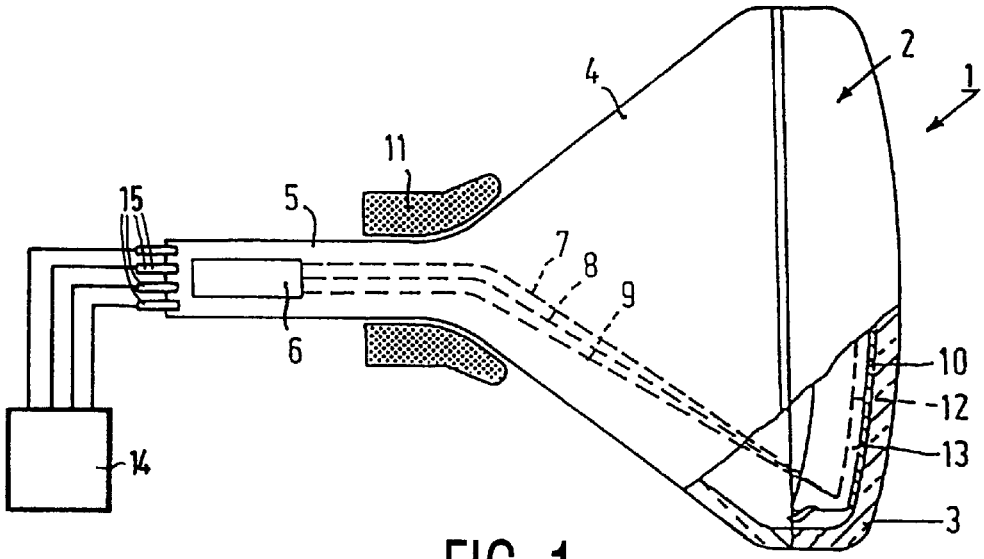
FIG. 1 shows an embodiment of a picture display device provided with a cathode ray tube according to the invention.

The embodiment of a picture display device shown in FIG. 1 is provided with a cathode ray tube 1 according to the invention having an evacuated envelope 2 with a display window 3, a cone 4 and a neck 5. The neck 5 accommodates an electron gun 6 for generating free electron beams 7–9 in this example. It is to be noted that within the scope of the invention the term electron gun should be considered to have a wide meaning and that it does not only include a single gun suitable for generating only one electron beam, but also integrated or non-integrated systems of often three electron guns which are described, for example in the present embodiment.

An electroluminescent display screen 10 comprising red, green and blue phosphor elements in this example is present at the inner side of the display window 3. The outer side of the envelope 2 is provided with deflection means 11 which are only shown diagrammatically and generally comprise a deflection unit in the form of a system of magnetic coils. On their path to the display screen 10, the electron beams 7–9 can be deflected by means of the deflection unit so that the entire display screen 10 can be scanned. The beams pass through color a selection means 12 which in this embodiment comprises a shadow mask in the form of a plate having apertures 13. The beams 7–9 pass through the apertures 13 at a small mutual angle and thus only impinge upon phosphor elements of the colour associated with the relevant beam 7, 8, 9. The picture display device further comprises means 14 for applying electric voltages to the electrodes of the electron gun, which means are shown diagrammatically in the figure, and in the final product are connected to the electron gun 6 by means of lead-through electrodes 15. The assembly further has a housing (not shown).

Figure 2:
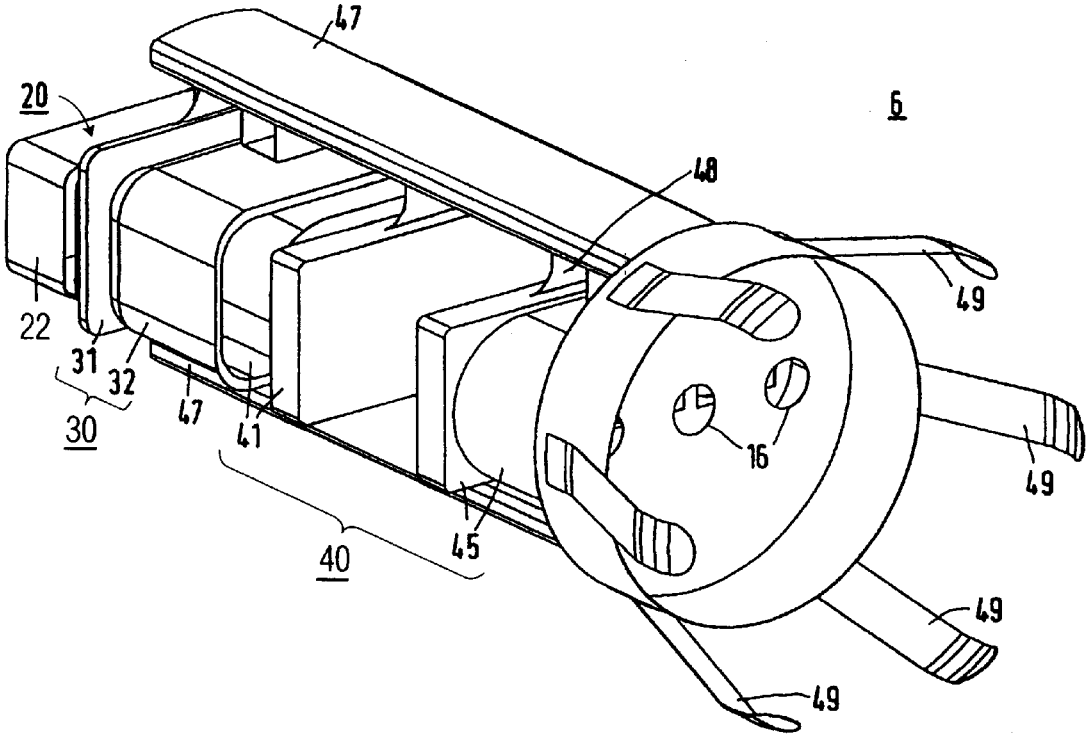
FIG. 2 is a perspective and detailed view of the electron gun of the picture display device shown in FIG. 1.

The electron gun 6 of the device of FIG. 1 is shown in perspective and greater detail in FIG. 2. The gun 6 comprises an electron beam-generating portion 20 referred to as the triode in which three juxtaposed electron sources are incorporated which are provided with a common electrode 22, often referred to as G1 which is connected to ground during operation. Similarly as all other electrodes of the electron gun 6, the common electrode 22 is provided with tree apertures 16 aligned in a row and having a diameter of approximately 5.5 mm for passing the electron beams.

The gun 6 also comprises a prefocusing system 30 of two successive electrodes 31, 32 having operating potentials of approximately 500 V and approximately 5.5 kV, respectively. The electron-optical prefocusing lens which is produced by this system 31, 32 of electrodes ensures that a virtual image is formed of each of the electron sources 21, which image serves as an object for a main focusing lens constituted by a main lens system 40 of electrodes in the gun.

The first electrode of the main lens system 40 is constituted by the last electrode 32 of the prefocusing system 30. Moreover, the main lens system comprises a final electrode 45 which is usually denoted as anode and is brought to a potential of typically approximately 25–30 kV during operation. During operation, the main lens system constitutes an electron-optical main lens and is responsible for an adequate focusing and convergence of the three generated electron beams on the display screen 11. More electrodes may be used in the main lens system so as to modify the potential variation in the main lens system and/or reduce potential jumps.

The various electrodes of the electron guns each comprise three aligned apertures 16 for passing the three electron beams and are each secured at both sides by means of securing means 48 to an insulating supporting body 47 having a conventional glass composition. This material can stand an electrostatic field strength of 3 kV/mm at the maximum. At a potential difference of 5 kV in the prefocusing system, this leads, at the location of the supporting body 47, to a mutual distance of minimally 1.7 mm between the electrodes 31, 32, increased by a margin to be inevitably considered for positioning tolerances and other process fluctuations.

The invention is based on the recognition that a considerably larger electric field strength is admissible at the location of the apertures 16 in the grids. There, the maximum field strength is only limited by the breakdown voltage in the prevailing vacuum, which is approximately 10 kV/mm at the maximum in a device of the type described. In accordance with the invention, at least one of the two electrodes 31, 32 therefore protrudes at the location of the apertures 16 towards the other electrode so that the distance $l_2$ between the electrodes and the location of the apertures 16 therein is considerably lower than their mutual distance $l_1$ at the location of the securing means 48. The electrodes 31, 32 are spaced apart at the location of the apertures 16 provided therein, substantially at a value limited by electrostatic breakdown, which in this case involves a distance $l_2$ of approximately 0.5 mm increased by a margin to be inevitably considered for positioning tolerances and other process fluctuations. In that case the electric field to which the electron beams in the prefocusing system 30 are subject is substantially maximal and more than a factor three larger than the maximum value along the supporting body 47, which leads to a considerable improvement of the prefocusing action of the gun, hence to a considerable improvement of the quality and homogeneity of the ultimate spot of the beam on the display screen.

In the relevant example this is achieved in that the second electrode 32 is composed of separate parts 321, 322, 323, a first part 321 of which comprises the securing means 48 and a second part 322 is arranged via or not via an intermediate part 323 at the side of the first part 321 facing the other electrode 31 and comprises the apertures 16 for passage of the electron beams. Approximately 0.8 mm thick sheet material is used for the separate parts of the electrode 32. The distance $l_2$ between the second part 322 and the first electrode is thus approximately 1.6 mm smaller than the distance $l_1$ between the first part 321 and the first electrode 31. The separate parts may be made, for example by means of punching and subsequently welded together.

Figure 3:
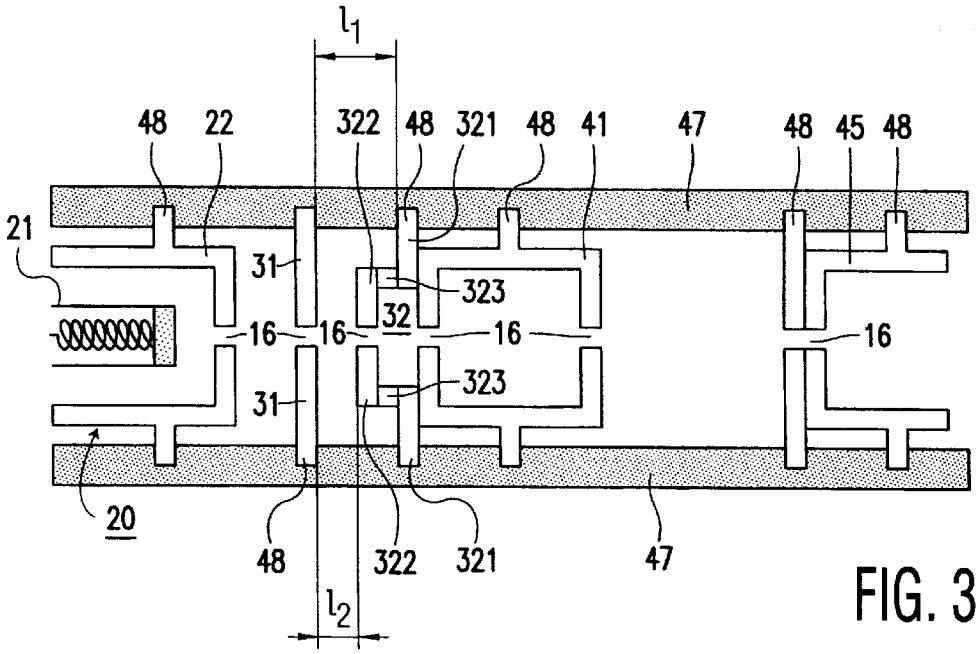
FIG. 3 is a diagrammatic cross-section of the electron gun of FIG. 2.
Figure 4:
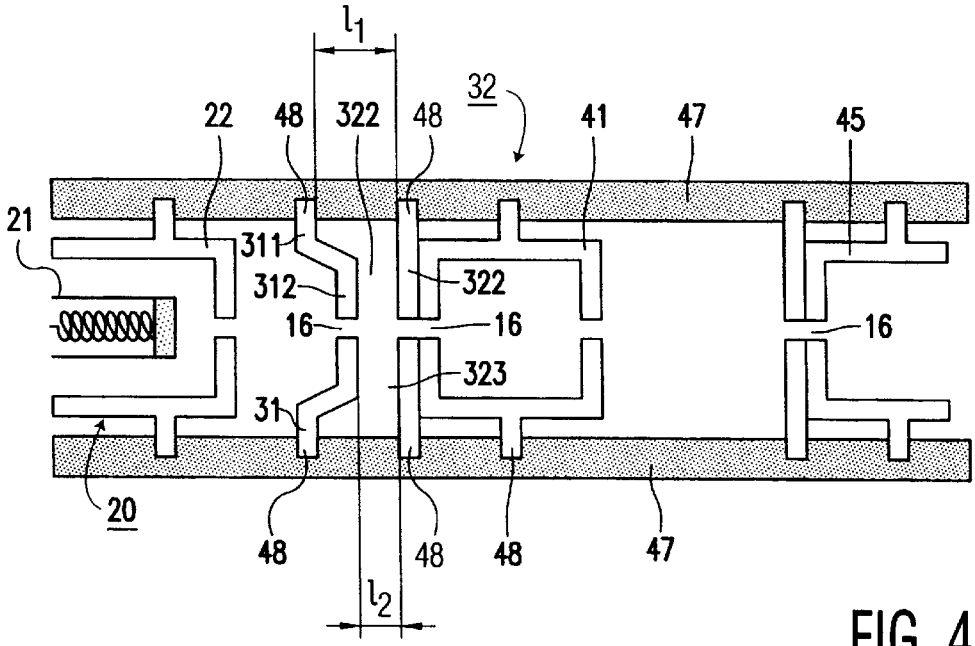
FIG. 4 is a diagrammatic cross-section of an alternative embodiment of the electron gun of FIG. 2.

An alternative embodiment of an electrode 31, 32 of the prefocusing system 30 is shown in FIG. 3. FIG. 3 shows diagrammatically a prefocusing system of the gun, the first electrode 31 of which has been deep drawn from approximately 0.4 mm thick sheet material or bent in such a way that a central part 312 thereof which comprises the apertures 16 for passing the electron beams protrudes approximately 1.5 mm with respect to the peripheral part 311 which is provided with the securing means 48. Thus, also in this case the mutual distance $l_2$ between the two electrodes 31, 32 of the prefocusing system 30 at the location of the apertures 16 is reduced to a limit value, defined by electrostatic breakdown, of approximately 0.1 mm per kV potential difference between the two electrodes 31, 32, increased by a margin to be inevitably considered for positioning tolerances and other process fluctuations. The distance $l_1$, at the location of the securing means 48 and the supporting body 47 is, however, amply maintained above the relevant limit value of 0.33 mm per kV potential difference.

Although the invention has been elucidated with reference to two embodiments, it will be evident that it is by no means limited to these embodiments and that those skilled in the art will be able to conceive many variations and forms without departing from the scope of the invention. For example, both electrodes of the prefocusing system may protrude towards each other so as to limit the relief per electrode. Alternatively, more than two electrodes and potentials may be used both in the prefocusing system and in the main lens system so as to further modify the beam shape and adapt it to specific requirements. The invention may notably also be used to advantage in tripotential guns in which at least a further electrode is used between the first and last electrode of the main lens system, which further electrode conveys a separate potential during operation, which potential is lower than the potential of the first electrode, and in guns of the DML type (Distributed Main Lens) or MSFL (Multi Stage Focus Lens) type in which the main lens system comprises a relatively large number of electrodes across which the main lens voltage is gradually distributed step-wise so as reduce the potential jumps in the main lens.

Moreover, the invention is not only important for integrated colour guns, but may also be used to advantage in separate colour guns and in monochrome guns. Moreover, the electrostatic lens system may be used in transmission electron microscopes (TEM), scanning electron microscopes (SEM), or in image intensifiers.

The invention generally provides a cathode ray tube of the type described in the opening paragraph with an electron gun having a stronger prefocusing without electrical adaptations of the gun being required.

What is claimed is:

1. A cathode ray tube comprising an electron gun having a beam shaping portion having at least one electron source for generating an electron beam, a prefocusing electrode system including first and second prefocusing electrodes across which a prefocusing voltage is supplied during operation so as to form an electron-optical prefocusing lens, the electron gun further comprising a main lens electrode system including first and second main lens electrodes provided with means for supplying, at least during operation, a main focusing voltage between said electrodes so as to form an electron-optical main focusing lens, each of said electrodes being provided with at least one aperture for passing the electron beam and with securing means with which the electrode is secured to at insulating supporting body, characterized in that the second prefocusing electrode and the first main lens electrode are mutually electrically connected, one of the first and second prefocusing electrodes protruding toward the other in such a way that the distance between said electrodes at the location of the apertures therein is smaller than at the location of the respective securing means thereof, in that the electrodes at the location of the apertures provided therein are spaced apart substantially at a distance which is limited by electrostatic breakdown and in that the distance between the first and second prefocusing electrodes at the location of the apertures therein is approximately a factor of three smaller than at the location of the respective securing means thereof.

2. A cathode ray tube as claimed in claim 1, characterized in that the distance between said first and second prefocusing electrodes at the location of the apertures is approximately equal to the quotient of the prefocusing voltage and the maximum electric field strength in the vacuum prevailing in the envelope, and in that the distance between said securing means is large than the quotient of the prefocusing voltage and the maximum electric field strength supporting body.

3. A cathode ray tube as claimed in claim 1, characterized in that at least one of the first and second prefocusing electrodes comprises at least two parts, a first part comprising the securing means and a second part being provided with the aperture for passing the at least one electron beam and being arranged at the side of the first part facing the other electrode of the system.

4. A cathode ray tube as claimed in claim 1, characterized in that at least one of the first and second prefocusing electrodes comprises a deep-drawn or bent part in which the aperture for passing the at least one electron beam is incorporated, said part extending towards the other one of said prefocusing electrodes.

* * * * *

UNITED STATES PATENT AND TRADEMARK OFFICE

CERTIFICATE OF CORRECTION

PATENT NO. : 6,259,195 B1 
DATED : July 10, 2001
INVENTOR(S) : Edwin A. Montie, Jeroen Van Engelshoven and Ronald van der Wilk It is certified that error appears in the above-identified patent and that said Letters Patent is hereby corrected as shown below:

Column 6,
Line 37, after "strength" insert -- along the --.

This certificate supersedes Certificate of Correction issued November 19, 2002.

Signed and Sealed this

Fourteenth Day of January, 2003

JAMES E. ROGAN
*Director of the United States Patent and Trademark Office*